US005121519A

United States Patent [19]

Haugom

[11] Patent Number: 5,121,519

[45] Date of Patent: Jun. 16, 1992

[54] GOLF CLUB GROOVE CLEANER AND TURF REPAIR TOOL

[76] Inventor: Howard Haugom, 509 - 825 Granville St., Vancouver, British Columbia, Canada, V6Z 1K9

[21] Appl. No.: 690,565

[22] Filed: Apr. 24, 1991

[51] Int. Cl.[5] ..... A63B 57/00

[52] U.S. Cl. ..... 15/105; 15/236.05; 15/236.08; 273/32 A

[58] Field of Search ..... 15/105, 236.05, 236.08, 15/237; 273/32 A; D21/234

[56] References Cited

U.S. PATENT DOCUMENTS

| | | | |
|---|---|---|---|
| D. 237,516 | 11/1975 | Yaudes | D21/234 |
| D. 249,814 | 10/1978 | Cudahy | D21/234 |
| D. 254,211 | 2/1980 | Gutknecht | D21/234 |
| D. 306,057 | 2/1990 | Vaughan | D21/234 |
| 3,763,515 | 10/1973 | Voss | 15/236.08 X |
| 4,535,987 | 8/1985 | Dikoff | 273/32 A X |
| 4,974,842 | 12/1990 | Widman | 273/32 A |
| 5,022,650 | 6/1991 | Madock | 15/106 X |

*Primary Examiner*—Chris K. Moore

[57] ABSTRACT

The invention provides a small, inexpensive cleaning device that is particularly made to clean the grooves in the face of most golf clubs heads, both irons and drivers. The object of these grooves is to give the ball direction and backspin. If these grooves become clogged the player no longer gets the proper backspin on the golf ball and loses directional accuracy. The device has at one end a series of small evenly spaced fixed teeth, each reinforcing ribs to minimize the risk of the teeth breaking while the device is being used to clean the golf club head. The device can be twisted with respect to the golf club head to enable the cleaning of a variety of evenly spaced parallel grooves. Additionally, the device has a pair of large sharp prongs on its opposite end, which can be used to clean golf shoes and to repair divots and golf ball marks in the turf on golf course greens. The prongs have a bend that can be used in conjunction with the edge of a ball mark depression on the golf green as a fulcrum to leverage the turf back to a level shape. A thumb grip concavity is equipped with tread lines to prevent the user's hand from slipping onto the teeth when the prongs of the device are being used to repair turf.

2 Claims, 1 Drawing Sheet

GOLF CLUB GROOVE CLEANER AND TURF REPAIR TOOL

FIELD OF THE INVENTION

This invention relates to combination golf tools that assist in cleaning the grooves in the face of a golf club head and in repairing divots and ball marks on golf greens.

The object of grooves on a golf club is to give the ball direction and backspin. If these grooves become clogged the player no longer gets the proper backspin on the golf ball and loses directional accuracy. Dealing with clogged grooves has been a problem faced by golfers for years.

A ball mark depression made by a golf ball landing on a golf green should be removed by the golfer, in order to be courteous to future putters. If these marks are not lifted up and leveled out, the green quickly becomes unpredictable to putters. Ideally, the green should be quite smooth, with only gradually changing contours beneath the close-cropped grass.

DESCRIPTION OF THE PRIOR TECHNOLOGY

There other cleaner devices designed specifically for golfers. For example, a device for cleaning the grooves of a golf club head is shown in U.S. Pat. No. 3,994,040, in which spaced flexible prongs having beveled tips are employed. An analogous device using spaced bevel-tipped ribs is shown in U.S. Pat. No. 4,086,678. There also exist devices for the repair of ball marks on golf greens, as shown in U.S. Pat. No. 3,185,483. None of the prior art discloses the features of the current invention. No other current product can match it in use, versatility, portability, and cost.

SUMMARY AND OBJECTS OF THE INVENTION

This invention is a golf club groove cleaner and golf green repair tool. It is a small, inexpensive plastic device that can be used to clean quickly and easily dirt and grass from the grooves on the faces of most golf club heads on the market, both irons and drivers. Additionally, the device can be used to repair divots and ball marks on golf course greens. The device easily fits in one's pocket.

In designing the groove cleaning end of the device, initial consideration was given to the peculiar groove of Ping (trademark of Ping International Corporation) golf clubs. The Ping iron is quite different from other irons on the market in that the distance between grooves is smaller than the majority of irons and the grooves are u-shaped rather than v shaped. While grooves in all irons become clogged with dirt and grass when used, irons with U-shaped grooves have a tendency of filling up with grass and dirt to a greater extent than irons with v-shaped grooves.

It is an object of the current invention to provide a golf club groove cleaner adapted to clean both U-shaped grooves and V-shaped grooves, and to clean a variety of clubs that differ in the distances between grooves on the club.

The groove cleaner is a small plastic device which has at one end a row of small evenly spaced, uniformly sized fixed teeth which are capable of cleaning most of the golf club irons on the market. The largest distance between grooves was found to be 0.140 inch. For grooves distanced 0.140 inches. apart the prongs simply fit into the grooves of the iron in a straight forward manner. On groove distances less than 0.140 inches. apart the groove cleaner is simply twisted at an angle so that the fixed prongs align in the grooves. The greater the angle the device is twisted the smaller the groove distance that can be accommodated. An effective length for the fixed teeth is approximately 0.100 inches. Reinforcing ribs are provided on the back and sides of each tooth to minimize the risk of a tooth breaking when the groove cleaner is being used, regardless of the angle to which the device is twisted in order to align with the grooves. The top face of each tooth should be approximately 0.035 inches across, and will thus be adapted to provide scraping ability in both U-shaped and V-shaped grooves.

At the other end of the groove cleaner is a golf green repair tool, comprising two large sharpened prongs. The prongs have a bend that can be used in conjunction with the edge of a ball mark depression on the golf green as a fulcrum to leverage the turf back to a level shape. The prongs can also be used to smooth out and pat down turf that is raised too much.

The ends of the golf green repair prongs are sharpened in order to penetrate the turf. The sharpened prongs also give the golfer the ability to clean between the cleats on golf shoes and to scrape any strongly stuck dirt from the grooves on wood or metal golf club drivers. The device is made from an extremely strong plastic which will not scratch or harm golf clubs.

On the front of the middle body portion of the device, there is a thumb grip concavity that is equipped with tread lines to prevent the user's hand from slipping onto the teeth when the prongs of the device are being used to repair turf.

DETAILED DESCRIPTION

Figure 1:
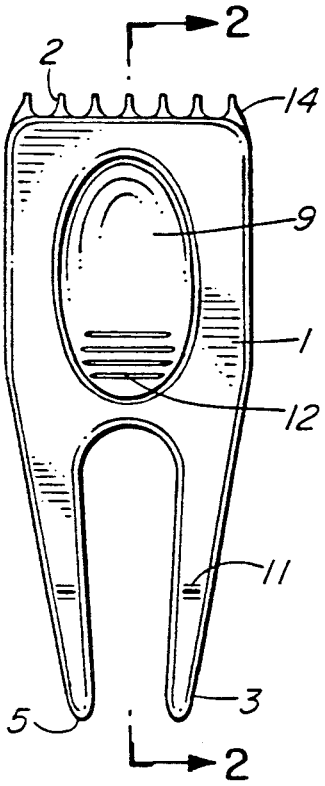
FIG. 1 is a front view of the device.

Referring to FIG. 1, the groove cleaner device has a body 1, a row of small teeth 2 for cleaning irons and a pair of large prongs 3 on the opposite end for cleaning drivers and repairing the turf on golf greens. The teeth are uniformly sized and spaced, and are aligned with each other in a row. A side reinforcing rib 14 is on each side of each tooth. The prongs are symmetrical in shape and placement about an axis through the length of the body 1. The front of the body 1 has a concavity 9 therein to accommodate the thumb of the user, with raised tread lines 12 in the concavity to enhance the user's grip of the device. The bend 11 in the prongs is also shown.

Figure 2:
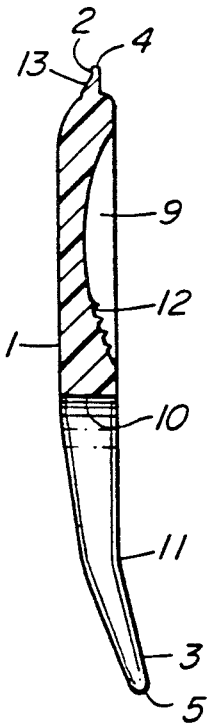
FIG. 2 is a side cross-section view of the device.

Referring to FIG. 2, the body 1 in a preferred embodiments is approximately 0.26 inches thick. Each tooth has a top face 4 that is approximately 0.035 inches across, and will thus be adapted to provide scraping ability in both U-shaped and V-shaped grooves. A back reinforcing rib 13 is on the back of each tooth. Each large prong 3 is much thicker and longer than the small teeth, being approximately 0.16 inches thick over a portion of its length for the strength required in to use the device to repair turf. Each large prong 3 is sharpened to a point 5. The concavity 9 and the tread lines 12 are also shown. The large prongs are below the juncture 10. The bend 11 in the prongs is also shown, such that each prong is angled frontward from the plane of the front of the body 1.

Figure 3:
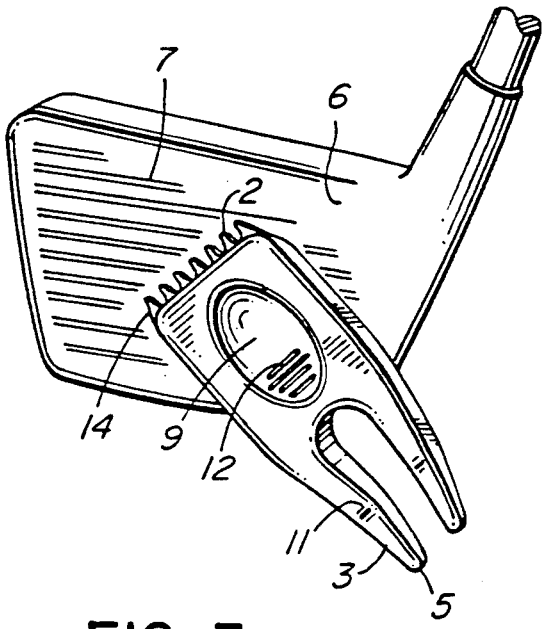
FIG. 3 is a perspective showing the device in use on the grooves of a golf club.

Referring to FIG. 3, the device can be twisted to clean a golf club face 6 having grooves 7 that are spaced more narrowly than the space of 0.14 inches between the small teeth 2. The side reinforcing ribs 14 and the bend 11 in the prongs are also shown.

Figure 4:
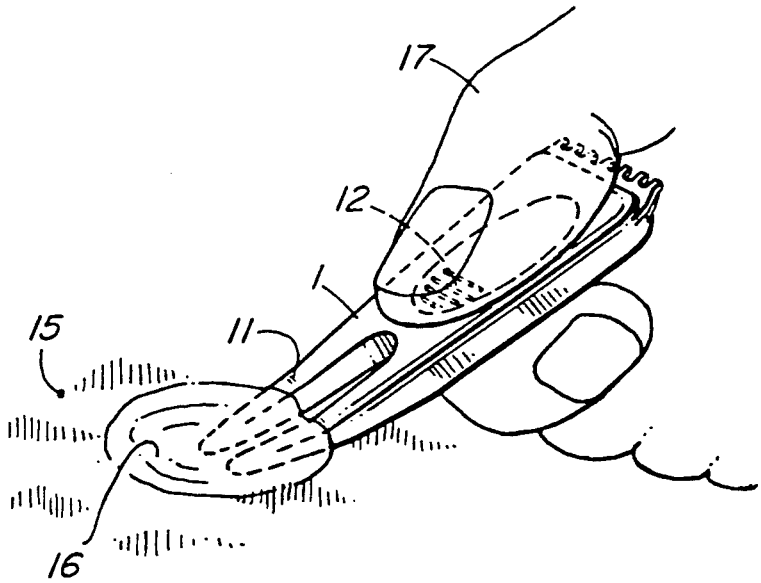
FIG. 4 is a perspective showing the device in use repairing a golf ball mark depression in the turf.

Referring to FIG. 4, the device is gripped by the user placing his thumb 17 on the tread lines 12 in the concavity on the front of the body 1. The bend 11 in the prongs is be used in conjunction with the edge of a ball mark depression 16 on the golf green 15 as a fulcrum to leverage the turf back to a level shape.

The product can be made at low cost in one piece, of one material, for example, by injection molding with high grade plastic. The device can be made in a variety of colors and is small enough to carry conveniently yet large enough to handle effectively. The size of the device is such that a golf club name or other promotional insignia could legibly be printed on it.

The groove cleaner can be equipped with a chain or clip so that it can be attached to a golf bag or an article of clothing.

The within-described invention may be embodied in other specific forms and with additional options and accessories without departing from the spirit or essential characteristics thereof. The presently disclosed embodiment is therefore to be considered in all respects as illustrative and not restrictive, the scope of the invention being indicated by the appended claims rather than by the foregoing description, and all changes which come within the meaning and range of equivalence of the claims are therefore intended to be embraced therein.

I claim:

1. A device for cleaning the grooves in the faces of golf club heads and for repairing turf, comprising a body from which extends on one end thereof a row of small evenly spaced, uniformly sized fixed teeth having reinforcing ribs on their sides and backs and from which extends on another end thereof two sharpened prongs, the prongs being symmetrical in shape and placement about an axis through the length of the body, and having a bend such that each prong is angled frontward from the plane of the front of the body.

2. The device of claim 1, in which the front of the main body has a concavity therein to accommodate the thumb of the user, with raised tread lines therein to enhance the user's grip of the device, in which the teeth are 7 in number and each tooth in the row of teeth is spaced 0.14 inches apart from the next tooth at the top of the teeth, each tooth being 0.1 inches in length from the body to the top of the tooth, each tooth having a reinforcing rib on the back of the tooth and on each side of the tooth adjacent to the back of the tooth and in which each prong is 0.16 inches thick over a portion of its length.

* * * * *